US006530183B1

(12) United States Patent
Kuei-Yung

(10) Patent No.: US 6,530,183 B1
(45) Date of Patent: Mar. 11, 2003

(54) ADJUSTABLE DOOR FRAME ASSEMBLY

(75) Inventor: Wang Chen Kuei-Yung, Taipei (TW)

(73) Assignee: Nan Ya Plastics Corporation, Taipei (TW)

( * ) Notice: Subject to any disclaimer, the term of this patent is extended or adjusted under 35 U.S.C. 154(b) by 0 days.

(21) Appl. No.: 09/657,577

(22) Filed: Sep. 8, 2000

(51) Int. Cl.[7] ..... E04C 2/38; E06B 1/04

(52) U.S. Cl. ..... 52/204.1; 49/504; 49/505; 52/656.9

(58) Field of Search ..... 49/504, 505, 468, 49/467, 469; 52/204.1, 217, 204.56, 213, 211, 212, 656.1, 656.2, 656.48, 656.9

(56) References Cited

U.S. PATENT DOCUMENTS 3,591,985 A * 7/1971 Coppins ..... 49/504
3,782,054 A * 1/1974 Goss, Jr. ..... 52/656.1 X
3,812,621 A * 5/1974 Ragland ..... 49/505
4,154,034 A * 5/1979 Bursk et al. ..... 49/504 X
4,180,944 A * 1/1980 Stowik et al. ..... 49/504
4,287,684 A * 9/1981 McKann ..... 49/468
4,719,729 A * 1/1988 Wynar ..... 52/211
4,831,779 A * 5/1989 Kehrli et al. ..... 49/469 X
4,831,804 A * 5/1989 Sayer ..... 52/656.1 X
5,012,614 A * 5/1991 Shea ..... 49/468
5,233,802 A * 8/1993 Rogers ..... 52/505 X
5,295,327 A * 3/1994 Dubois ..... 49/504
5,363,611 A * 11/1994 Richardson et al. ..... 49/504 X
5,392,574 A * 2/1995 Sayers ..... 52/213 X
5,603,191 A * 2/1997 Wu ..... 49/504 X
5,619,823 A * 4/1997 Ruff et al. ..... 49/504
5,651,222 A * 7/1997 Bridges et al. ..... 52/211
5,671,580 A * 9/1997 Chou ..... 52/656.4
5,815,998 A * 10/1998 Wamsher ..... 52/211
5,921,039 A * 7/1999 Sanders ..... 49/504 X
5,974,745 A * 11/1999 Barr ..... 52/212
6,125,599 A * 10/2000 Mess et al. ..... 52/212 X

* cited by examiner

*Primary Examiner*—David M. Purol
*Assistant Examiner*—Hugh B. Thompson
(74) *Attorney, Agent, or Firm*—Bacon & Thomas, PLLC

(57) ABSTRACT

An adjustable door frame assembly. The door frame assembly is to be adapted to fit door openings of different sizes. The door frame assembly utilizes co-extrusion technic for the components, including PVC foamed plastics frames, a corner connecting metal piece, a U-shape reinforced metal piece and co-extruded soft strips. The corner connecting metal piece fixes two adjacent frames such as the left and the top to form a " " type frame, and then to be joined with the bottom threshold to complete this door frame assembly. The door frame assembly is height or width adjustable by cutting off parts of the side frames to change the dimensions of the door to fit the door openings for different sizes of various buildings.

4 Claims, 5 Drawing Sheets

ADJUSTABLE DOOR FRAME ASSEMBLY

BACKGROUND OF THE INVENTION

1. Field of the Invention

The present invention relates to adjustable door frames therefor and, more specifically, to a door frame assembly that could be adjusted to fit the door opening of different sizes preset in various buildings.

It uses PVC foamed plastics as the door frame material and takes the advantage of their easy cutting property. In addition, the co-extrusion technic is also applied in this invention to upgrade the air and water-tight quality of traditional door frames.

2. Description of Related Art

Traditionally, when installing a prefabricated door frame in a preset wall opening, it is often necessary to cut the door frame so that they will properly fit in the opening space when the opening size is non-standard or irregular. This presents a difficulty and takes more extra time when installing a door frame, and it may even damages the appearance and strength of the door or requires to change a new door frame for installation. Also, it need a larger place to store many different sizes of door frames and more manpower to take charge of the difference.

Several prior arts which deal with this problem including doors and frames which are adjustable in height and width and frames which accommodate walls of different thickness. However, none of the prior art discloses a door frame assembly in which the door frame materials are soft enough to be easily cut off for adjusting the door height or width so that the frame can accommodate wall openings of different heights.

U.S. Pat. No. 4,922,659, issued May 8, 1990 to Muccioli, shows an adjustable door and frame assembly in which the height and width of the door adjusts telescopically and in which the height and width of the frame is adjusted by removing pre-cut portions of the header and jamb members.

U.S. Pat. No. 5,291,688, issued Mar. 8, 1994 to Pederson which are adjusted by moving an edge portion of the door relative to a central portion. These doors require interfitted moving parts unlike the door of the present invention which is adjusted by cutting PCV foamed plastic iambs.

U.S. Pat. No. 4,825,610, issued May 2, 1989 to Gasteiger and U.S. Pat. No. 5,038,538, issued Aug. 13, 1991 to Rozon show door frames with telescoping frame extension members, which allow the frames to be installed in wall openings of various sizes. However, its adjusting method is different from this invention.

U.S. Pat. No. 5,845,439, issued Dec. 8, 1998 to Hendley, disclosed away by removing some different sizes of the door's core pieces to adjust the door and frame dimension, however, it did not mention any technics utilizing the easy cutting materials likes the PVC foamed plastics to adjust the door height or width by cutting pieces of frame, either.

None of the above inventions and patents, taken either singularly or in combination, is seen to describe the instant invention as we claimed. Thus, an adjustable door frame assembly solving the aforementioned problems is deserved to be patented.

SUMMARY OF THE INVENTION

The present invention is an adjustable door frame assembly created to fit door openings of different sizes. The door frame using the technology of co-extruding plastics for the installation in door openings comprises PVC foamed plastics jambs, comer connection metal piece, an L-shaped reinforced metal and co-extruded soft stripes to form a U-shaped frame first and to be joined with the bottom threshold to become a door frame assembly characterized in its selectively adjustable height or width which is achieved by cutting off part of the side jambs, to fit in different door opening preset in various of buildings.

The frame is also designed a U shape groove on its back to interfit the same shape metal material for reinforcement. In addition, it is co-extruded with soft gaskets for reducing noise and securing airtight quality. On the same way, its bottom jamb is also co-extruded with soft gasket for water resistant and air-tight purpose, and co-extruded with anti-slide strip for safety. More over, it increases the height for bottom threshold to enhance the ability of the wind pressure resistance.

Accordingly, it is a principal object of the invention to provide a door frame assembly which may be installed in door openings with different heights or widths through cut-off process on easy cutting structure and materials.

It is another object of the invention to provide a door and frame assembly which utilizes co-extrusion technic to combine the door frame with soft gasket while it is produced, to improve the qualities regarding air-tight water-resistant and anti-slide.

It is a further object of the invention to combine threshold and foot plate together, and to increase the height of threshold for the wind pressure resistance.

DETAILED DESCRIPTION OF THE PREFERRED EMBODIMENTS

Figure 1:
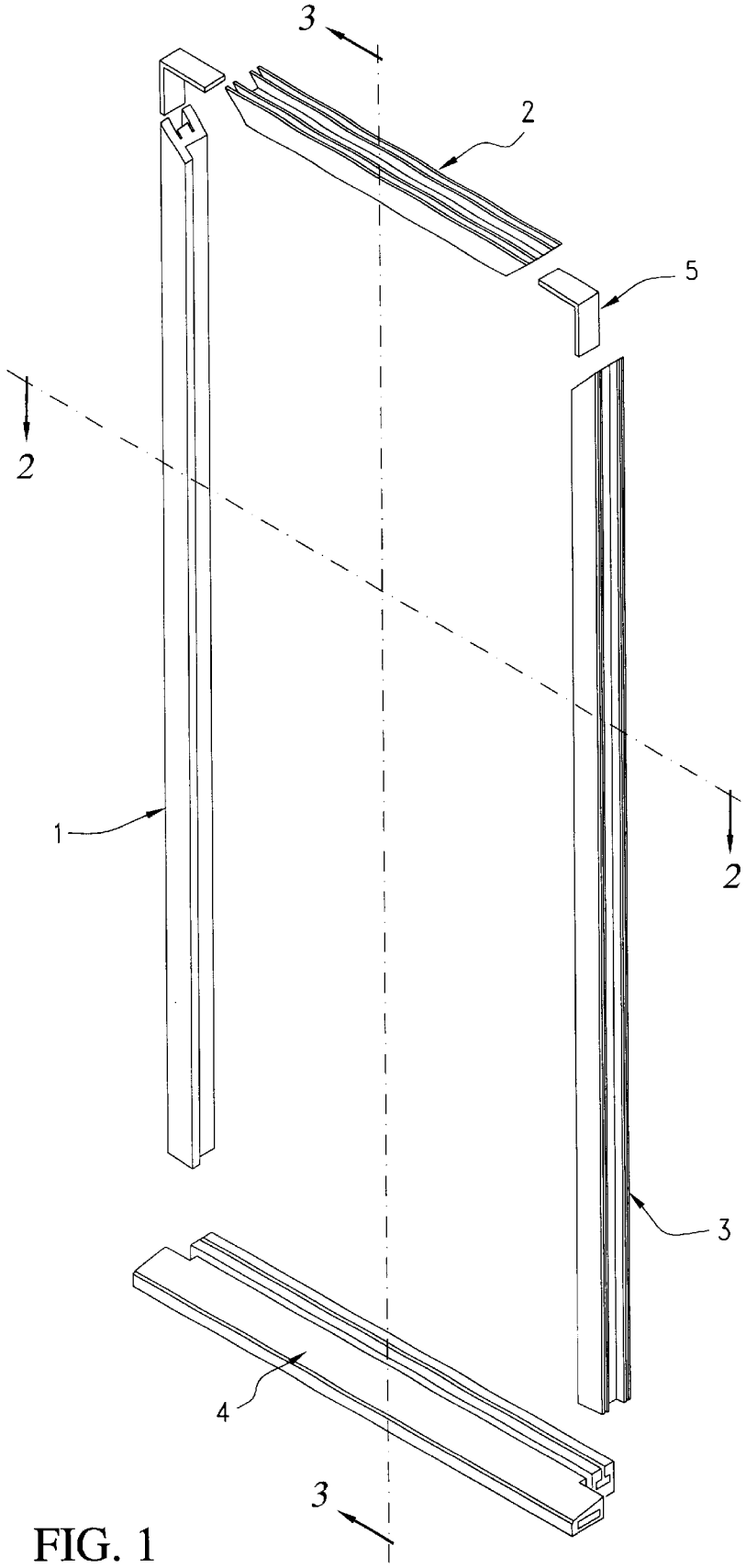
FIG. 1 is an exploded view of the adjustable door frame of the present invention showing the assembling construction.

Referring to the drawings, this invention includes an h-shaped top or upper frame 2 made of PVC foamed plastic co-extruded with a soft gasket, an h-shaped left frame 1, an h-shaped right frame 3, two L-shaped corner connecting metal pieces 5, reinforced metal pieces 7 having a U-shaped cross section and a bottom threshold 4. FIG. 1 illustrates the assembling procedures. First, the left frame 1 and the top frame 2 are attached together, preferably by screws with a corner connecting metal piece 5, followed in the same way by fixing the right frame to a second corner connecting metal piece 5 to form a U-shaped frame. Finally, the ends of the left and the right frames 1, 3 are placed into preset holes at two ends of a bottom threshold 4.

Figure 2:
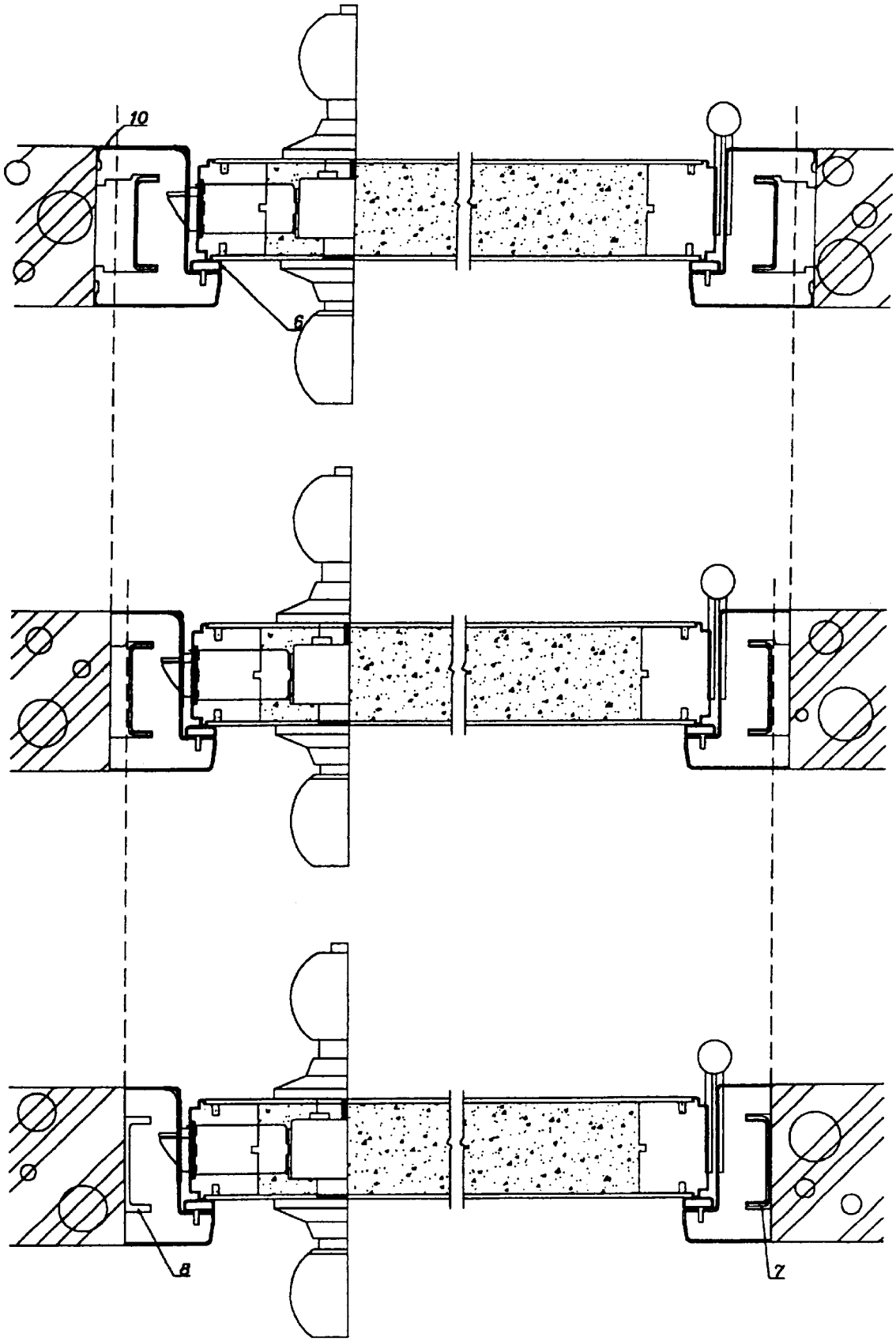
FIG. 2 is the cross sectional view of 2—2 on FIG. 1 showing the door frame adapted to different width of door openings after cut-off.

FIG. 2 illustrates how bottoms 10 of the left and right side frames 1, 3 can be cut for different widths of door openings.

Figure 3:
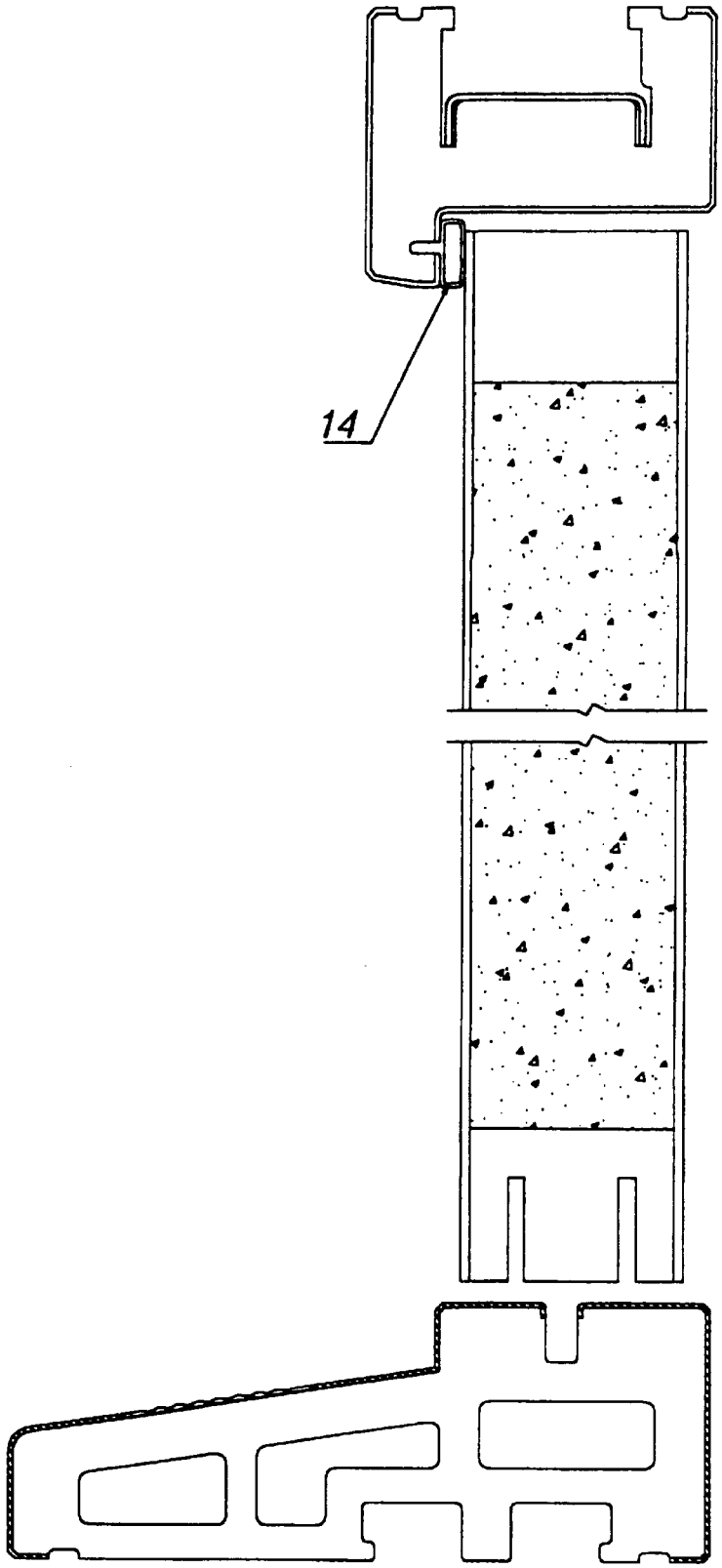
FIG. 3 is a vertical sectional view of the assembling between the door and the side strips of the middle frame.
Figure 4:
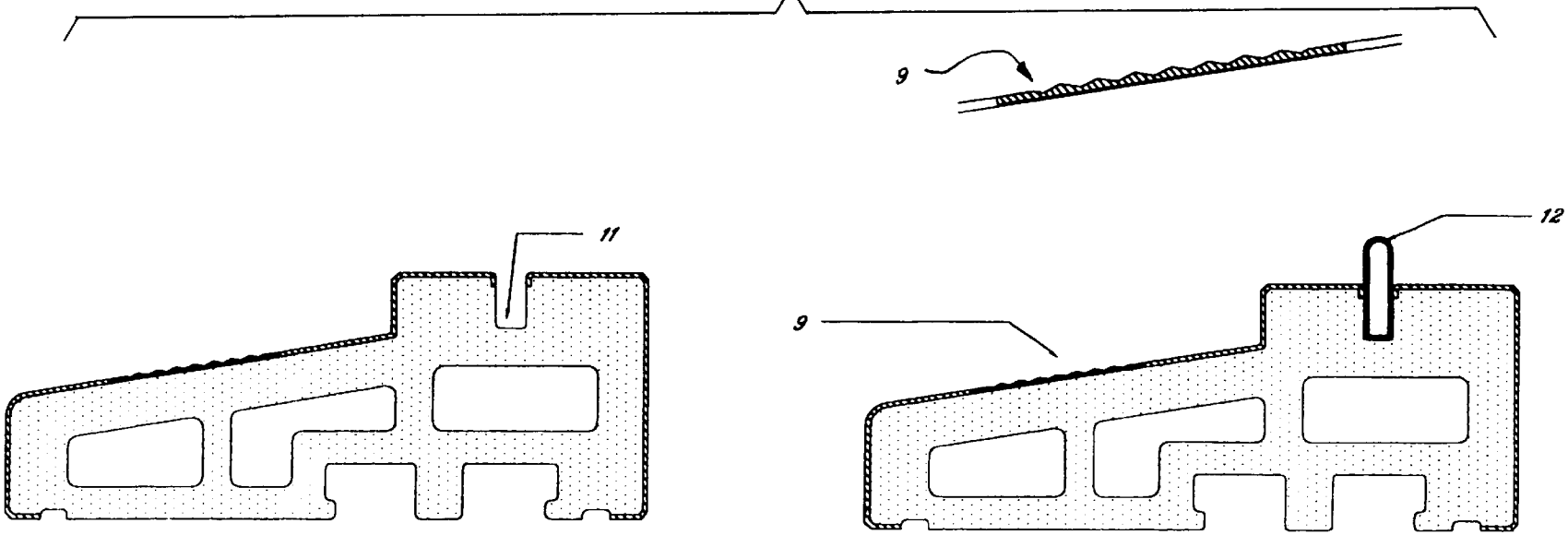
FIG. 4 is a perspective view of the threshold.

The main body frame includes a soft gasket 6 to save assembly time. In addition, the inner groove 8 at the bottoms of the frames could be inserted with the reinforced metal 7 having a U-shaped cross section to increase the rigidity of the door frame and to prevent deformation due to moisture or heat. The bottom threshold 4 is also co-extruded and includes a soft gasket such as an anti-slide strip 9 for safety. Moreover, FIG. 3 and FIG. 4 illustrate that the height of the anti-slide strip 9 can be increased to resist wind pressure, and the top of the threshold 4 is designed with a groove 11 for receiving a soft water resistant gasket 12 to provide the function for making airtight and water proof for the body frame.

Figure 5:
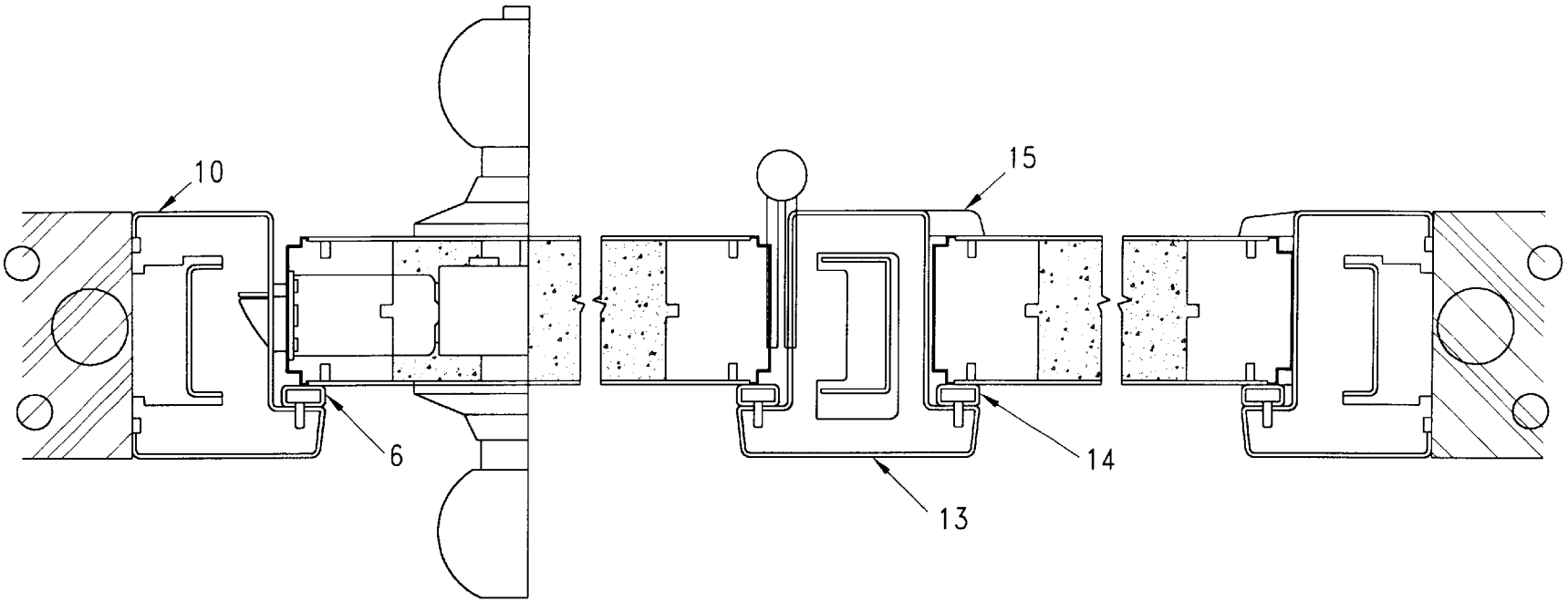
FIG. 5 is a cross sectional view of the T-shaped middle frame of this invention mounted on to double doors.

FIG. 5 shows a T-shaped middle frame 13 adapted for being fitted to double door frames. The T-shaped middle frame 13 includes a pair of soft strips 14 as shown in FIG. 5.

It is to be understood that the present invention is not limited to the embodiments described above, but encompasses any and all embodiments within the scope of the following claims.

What is claimed is:

1. An adjustable door frame assembly comprising:

a left frame piece;

a right frame piece;

an upper frame piece;

first and second L-shaped corner connecting metal pieces;

each of the frame pieces having a substantially h-shaped cross section, lower extensions of the h-shaped cross sections of the frame pieces are adapted to be cut in order to custom-fit into a particular sized opening for the door frame assembly;

the left and right frame pieces are spaced apart, the upper frame piece is connected to the left and right frame pieces at upper ends of the left and right frame pieces to form a U-shaped sub-assembly;

the first L-shaped corner connecting metal piece attached to the left and upper frame pieces, and the second L-shaped corner connecting metal piece attached to the right and upper frame pieces to secure the U-shape sub-assembly the L-shaped corner connecting metal pieces being received substantially within and across a horizontal width of said h-shaped cross-sections;

a bottom threshold shaped to receive bottom ends of the left and right frame pieces; and the left, right and upper frame pieces and the bottom threshold are joined together and are comprised of co-extruded polyvinyl chloride material.

2. The adjustable door frame assembly as claimed in claim 1, wherein at least one of the frame pieces is comprised of a co-extruded soft gasket that is adapted to provide a seal between the door frame assembly and a door positioned therein.

3. The adjustable door frame assembly as claimed in claim 1, wherein the bottom threshold comprises a groove extending along an upper surface thereof between the left and right frame pieces, and further comprising a soft strip secured onto the groove and adapted to provide a seal between the door frame assembly and a door positioned therein.

4. The adjustable door frame assembly as claimed in claim 1, further comprising reinforced metal pieces having a U-shaped cross section each secured to respective ones of the frame pieces substantially along the lengths of the frame pieces, and the reinforced metal pieces are adapted to brace the frame pieces.

* * * * *